US007267087B2

(12) United States Patent
Glugla

(10) Patent No.: US 7,267,087 B2
(45) Date of Patent: Sep. 11, 2007

(54) VARIABLE COMPRESSION RATIO SCHEDULING AT IDLE SPEED CONDITIONS

(75) Inventor: Christopher Glugla, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/291,382

(22) Filed: Dec. 1, 2005

(65) Prior Publication Data

US 2007/0125322 A1 Jun. 7, 2007

(51) Int. Cl.
*F02B 75/04* (2006.01)

(52) U.S. Cl. ..... 123/48 R

(58) Field of Classification Search ..... 123/48 R, 123/48 B, 78 E, 78 F
See application file for complete search history.

(56) References Cited

U.S. PATENT DOCUMENTS 4,724,810 A * 2/1988 Poirier et al. ..... 123/339.16
5,400,755 A 3/1995 Maebashi
6,553,949 B1 * 4/2003 Kolmanovsky et al. ... 123/48 B
6,970,781 B1 * 11/2005 Chen et al. ..... 701/111
7,028,647 B2 * 4/2006 Styron ..... 123/48 B

* cited by examiner

*Primary Examiner*—Stephen K. Cronin
*Assistant Examiner*—Hyder Ali
(74) *Attorney, Agent, or Firm*—Diana Brehob

(57) ABSTRACT

A method for selecting compression ratio of a variable compression ratio internal combustion engine when such engine is operating under an idle condition is disclosed. The compression ratio is selected to avoid engine knock, an undesirable phenomenon which is more likely at higher temperatures, higher compression ratios, lower engine speeds, and higher engine torques. The selected compression ratio is based on one or more of engine torque required to drive engine accessories, engine coolant temperature, engine air temperature, and transmission status (neutral idle or drive idle). A normalized airflow parameter is computed or found in a lookup table based on engine coolant temperature and engine air temperature. When actual normalized airflow (that which provides necessary engine torque to drive engine accessories and overcome engine friction) exceeds normalized airflow parameter exceeds, a higher compression ratio is selected.

15 Claims, 3 Drawing Sheets

Is engine entering idle condition ?
200
No
220
Base compression ratio selection on other criteria
Yes
202
NAp
Increasing ACT
ECT
Is NA > NAp ?
204
No
206
Command high compression ratio
Yes
208
Command low compression ratio
Have ACT or ECT changed significantly ?
210
Yes
No
212
Continue at same compression ratio Is engine entering idle condition ?
300
No
320
Base compression ratio selection on other criteria
Yes
302
NAp
Increasing ACT
ECT
Determine new Compression ratio, CR = fnc (NA-NAp)
304
Command new compression ratio
306
Have ACT or ECT changed significantly ?
310
Yes
No
Continue at same compression ratio
312

VARIABLE COMPRESSION RATIO SCHEDULING AT IDLE SPEED CONDITIONS

TECHNICAL FIELD

This invention relates generally to internal combustion engines having variable compression ratios and more particularly to methods for scheduling the compression ratio for reciprocating, internal combustion engines.

BACKGROUND AND SUMMARY

As is known in the art, the compression ratio of an internal combustion engine is defined as the ratio of the cylinder volume when the piston is at bottom-dead-center (BDC) to the cylinder volume when the piston is at top-dead-center (TDC)—generally, the higher the compression ratio, the higher the thermal efficiency and fuel economy of the internal combustion engine. In spark-ignition engines, compression ratios are limited by engine knock or autoignition which tends to occur at lower engine speeds and higher engine torques. Engine knock does not typically occur at engine idle, which is a low speed, low torque condition. However, if the other factors leading to knock, such as low humidity, high ambient temperature, low octane fuel, etc. occur, the engine can knock at idle. This is further exacerbated when engine accessory loads are placed on the engine so that the torque requirements are higher than an unloaded idle condition, such accessories being air conditioning and power steering pump, as examples.

So-called variable compression ratio (VCR) internal combustion engines have been developed to allow using higher compression ratios during knock-free conditions to take advantage of the high thermal efficiency and lower compression ratios during knock prone conditions. The inventor of the present invention has recognized that the problem of idle knock could be further exacerbated if the VCR selection is in a higher compression ratio.

The inventor of the present invention has recognized that operating at a high compression ratio at idle may result in engine knock, particularly when the exacerbating conditions listed above also exist.

SUMMARY OF THE INVENTION

Engine knock at idle is overcome by a method for selecting compression ratio by basing the compression ratio selection on demanded engine torque and a temperature, temperature being the air charge temperature and engine coolant temperature. The demanded engine torque is based on accessory loads on the engine and transmission status. The transmission is either in a neutral idle or drive idle state.

The method includes commanding the determined compression ratio and a desired idle speed to the engine, where the desired idle speed is found based on at least one of catalyst temperature, engine coolant temperature, engine coolant temperature at engine startup, air charge temperature, accessory loads on engine, said selected compression ratio, and transmission state.

According to an aspect of the invention, the engine compression ratio in a variable compression ratio device coupled to an idling internal combustion engine is selected based on a normalized airflow parameter, which is based on temperature, and an actual normalized airflow. The normalized airflow parameter is determined based on air charge temperature and engine coolant temperature. Actual normalized airflow is determined as airflow provided to the engine to provide the demanded torque divided by airflow if the cylinder were filled with air at ambient pressure and temperature. A high compression ratio is selected when actual normalized airflow is less than the normalized airflow parameter and a low compression ratio is selected when actual normalized airflow is greater than the normalized airflow parameter. With a multi-step or continuously variable VCR device, the selected compression ratio is determined as a function of actual normalized airflow and the normalized airflow parameter.

In a further aspect of the invention, the normalized airflow parameter is based on fuel efficiency, in particular in such a way as to maximize fuel efficiency. According to another aspect of the invention, the normalized airflow parameter is based maintaining combustion stability above a threshold. In one embodiment, combustion stability can be determined from standard deviation of IMEP.

In a further aspect of the invention idle speed is computed based on the selected compression ratio and at least one of a temperature of the catalyst, engine coolant temperature, air charge temperature, engine coolant temperature at engine startup, state of the transmission, air conditioner compressor load, and power steering load. The method also includes commanding the desired idle speed and the selected compression ratio so as to ensure smooth engine operation during transitions.

In yet another feature of the invention, the normalized airflow parameter is determined as function of engine coolant temperature and air charge temperature to avoid engine knock.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
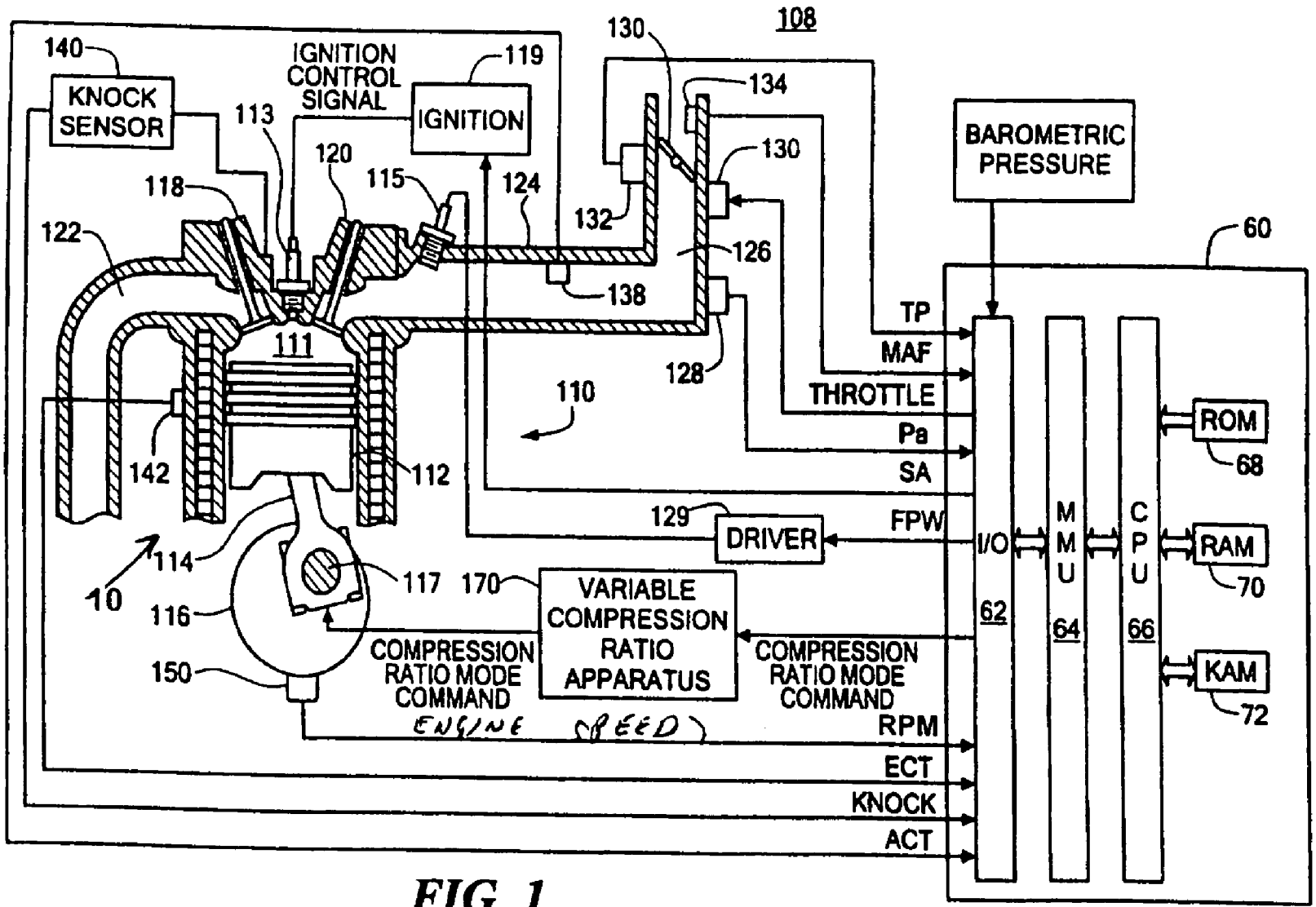
FIG. 1 is a diagram of an internal combustion engine system having variable compression ratio and a controller for selecting such ratio in accordance with the invention.

FIG. 1 shows an exemplary variable compression ratio internal combustion engine 10 in accordance with the present invention. As will be appreciated by those of ordinary skill in the art, the present invention is independent of the particular underlying engine configuration and component designs, and as such can be used with a variety of different internal combustion engines having more than one compression ratio operating modes. The engine for example can be constructed and arranged as a discrete compression ratio engine operating for example at a high compression or at low compression, or as a continuously variable compression ratio engine capable of operating at an infinite number of discrete compression ratios. Similarly, the present invention is not limited to any particular type of apparatus or method required for varying the compression ratio of the internal combustion engine.

Referring again to FIG. 1, the engine 110 includes a plurality of cylinders (only one shown), each having a combustion chamber 111, a reciprocating piston 112, and intake and exhaust valves 120 and 118 for communicating the combustion chamber 111 with intake and exhaust manifolds 124 and 122. The piston 112 is coupled to a connecting rod 114, which itself is coupled to a crankpin 117 of a crankshaft 116. Fuel is provided to the combustion chamber 111 via a fuel injector 115 and is delivered in proportion to a fuel pulse width (FPW) determined by an electronic engine controller 60 (or equivalent microprocessor-based controller) and electronic driver circuit 129. Air charge into the intake manifold 124 is nominally provided via an electronically controlled throttle plate 136 disposed within throttle body 126. Ignition spark is provided to the combustion chamber 111 via spark plug 113 and ignition system 119 in accordance with a spark advance (or retard) signal (SA) from the electronic controller 60.

As shown in FIG. 1, the engine controller 60 nominally includes a microprocessor or central processing unit (CPU) 66 in communication with computer readable storage devices 68, 70 and 72 via memory management unit (MMU) 64. The MMU 64 communicates data to and from the CPU 66 and among the computer readable storage devices, which for example may include read-only memory (ROM) 68, random-access memory (RAM) 70, keep-alive memory (KAM) 72 and other memory devices required for volatile or non-volatile data storage. The computer readable storage devices may be implemented using any known memory devices such as semiconductor chip programmable read-only memory (PROMs), electrically programmable read-only memory (EPROMs), electrically erasable PROM (EEPROMs), flash memory, or any other electrical, magnetic, optical or combination memory devices capable of storing data, including executable code, used by the CPU 66 for controlling the internal combustion engine and/or motor vehicle containing the internal combustion engine. Input/output (I/O) interface 62 is provided for communicating with various sensors, actuators and control circuits, including but not limited to the devices shown in FIG. 1. The executable code instructions for providing the combustion ratio selection will be described below in connection with FIG. 3. These devices include an engine speed sensor 150, electronic fuel control driver 129, ignition system 119, manifold absolute pressure sensor (MAP) 128, mass air flow sensor (MAF) 134, throttle position sensor 132, electronic throttle control motor 130, inlet air temperature sensor 138, engine knock sensor 140, and engine coolant temperature 142.

The engine 110 of FIG. 1 also includes and a variable compression ratio apparatus 170. In a non-limiting embodiment, the variable compression ratio apparatus 170 is operated to vary the effective length of the connecting rod 114, and thus the clearance volume and compression ratio of the engine. Such an apparatus is described, for example, in U.S. application Ser. No. 09/682,263, entitled "Connecting Rod for a Variable Compression Engine," which is owned by the assignee of the present invention and is hereby incorporated by reference in its entirety. The actual construction and configuration of the variable compression apparatus shown in FIG. 1 is not at all intended to limit the scope of claim protection for the inventions described herein. Other examples are described in U.S. Published Patent Application Publication 2005/0150471 A1, entitled "Variable Compression Ratio Connecting Rod for Internal Combustion Engine," and U.S. Pat. No. 6,857,401 B1, entitled "Variable Compression Ratio Sensing System for Internal Combustion Engine," both assigned to the same assignee as the present invention.

In a non-limiting aspect of the present invention, the variable compression ratio apparatus of FIG. 1 is described below as operating in a "high" compression ratio mode (compression ratio of 13:1 and above) or a "low" compression ratio mode (compression ratio of 11:1 and below). Alternatively, the variable compression ratio apparatus is continuously variable. In yet another alternative, the variable compression ratio apparatus has multiple (more than two), discrete compression ratio settings.

According to the present invention, the compression ratio which avoids knock is determined based on engine coolant temperature (ECT), air charge temperature (ACT), and engine torque. Engine torque, which is necessary to rotate the engine, depends on the number of engine accessories loading the engine and the state of the transmission, specifically, whether neutral or drive idle. For spark ignition engines, it is common to describe the engine torque in terms of airflow into the engine, since the torque that the engine produces is proportional to the airflow amount. Actual normalized airflow (NA) is defined as airflow divided by airflow if the cylinder were filled with air at ambient pressure and temperature. Because a spark-ignition engine is throttled, particularly at an idle condition, the normalized airflow is typically around 0.2.

Figure 2:
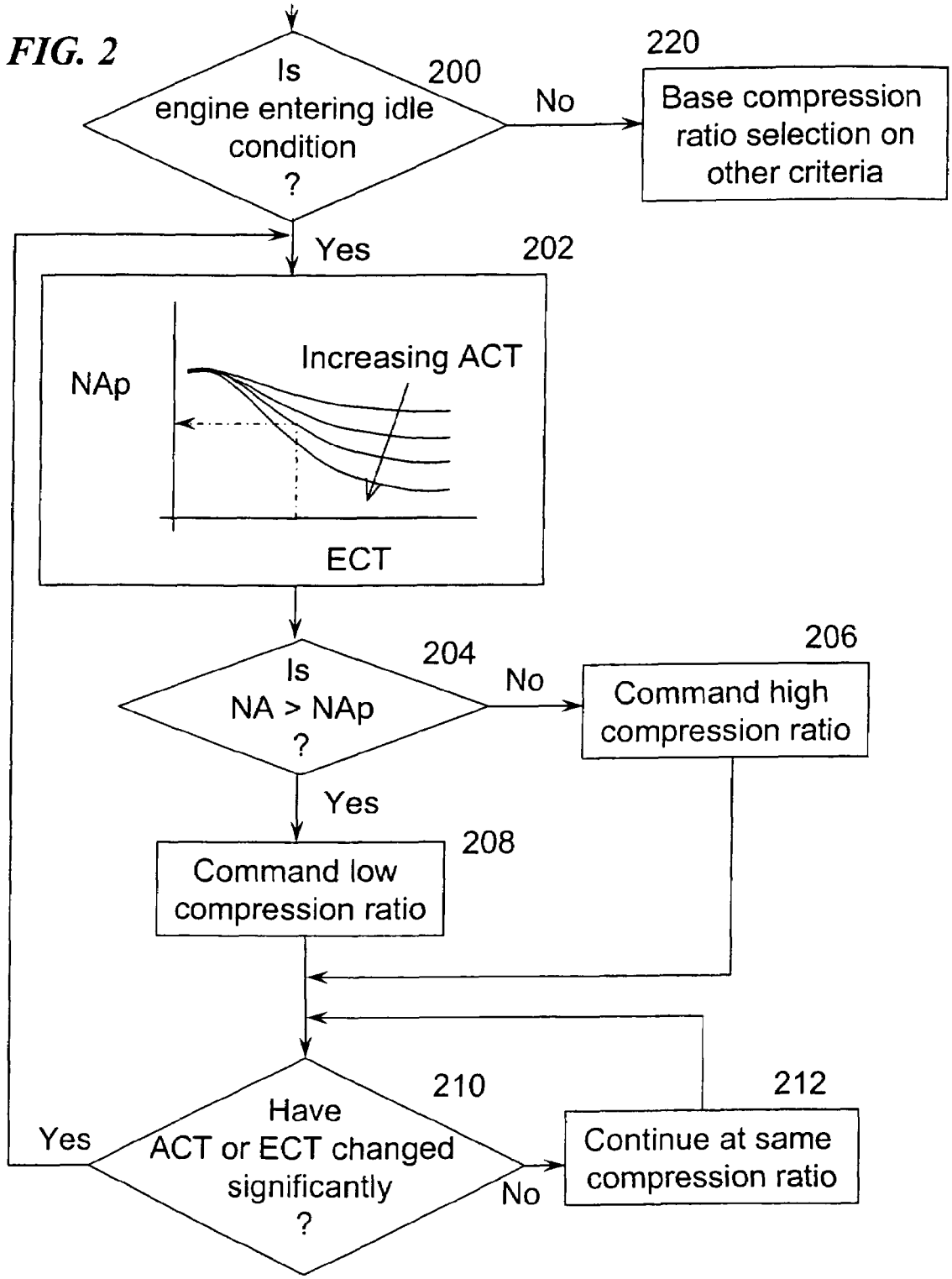
FIG. 2 is a flow diagram of a process used by the engine of FIG. 1 for selecting compression ratio and idle speed of the engine of FIG. 1 according to the invention.

Referring to FIG. 2, it is determined in block 200 whether the engine is dropping into an idle condition, i.e., whether idle speed control algorithms should be invoked. If not, control passes to block 220 where compression ratio is based on other criteria which are not the subject of the present invention. If the engine is idling, control passes to block 202 in which a normalized airflow parameter is determined. In block 202, a graph of NAp as a function of ECT is shown for a family of ACT curves. An example is shown in FIG. 2 where for a given ECT, the appropriate ACT curve is selected, to find the normalized airflow parameter. As either ECT or ACT increase, the value of NAp is reduced. Control passes to block 204 in which NA is compared with NAp. If NA is greater, then control passes to block 208 in which a low compression ratio is selected. The low compression ratio results because the temperatures are high and/or the normalized airflow (NA) is high which increases knock tendency. To overcome this tendency, the low compression ratio is selected. If NA is less than NAp, the higher compression ratio is selected in block 208, meaning that the conditions are such that knock is unlikely to occur and the higher efficiency of the high compression ratio can be used without incurring knock. Both blocks 206 and 206 lead to block 210 in which it is determined if a significant change in ACT or ECT has occurred. Such a situation may occur, for example, during an extended idle period at rest where the engine heats up due to limited air flowing over the engine block. If a significant change has occurred, control is passed to block 202 where a new NAp is determined. If a negative result from block 210, control passes to block 212, in which compression ratio remains constant.

Figure 3:
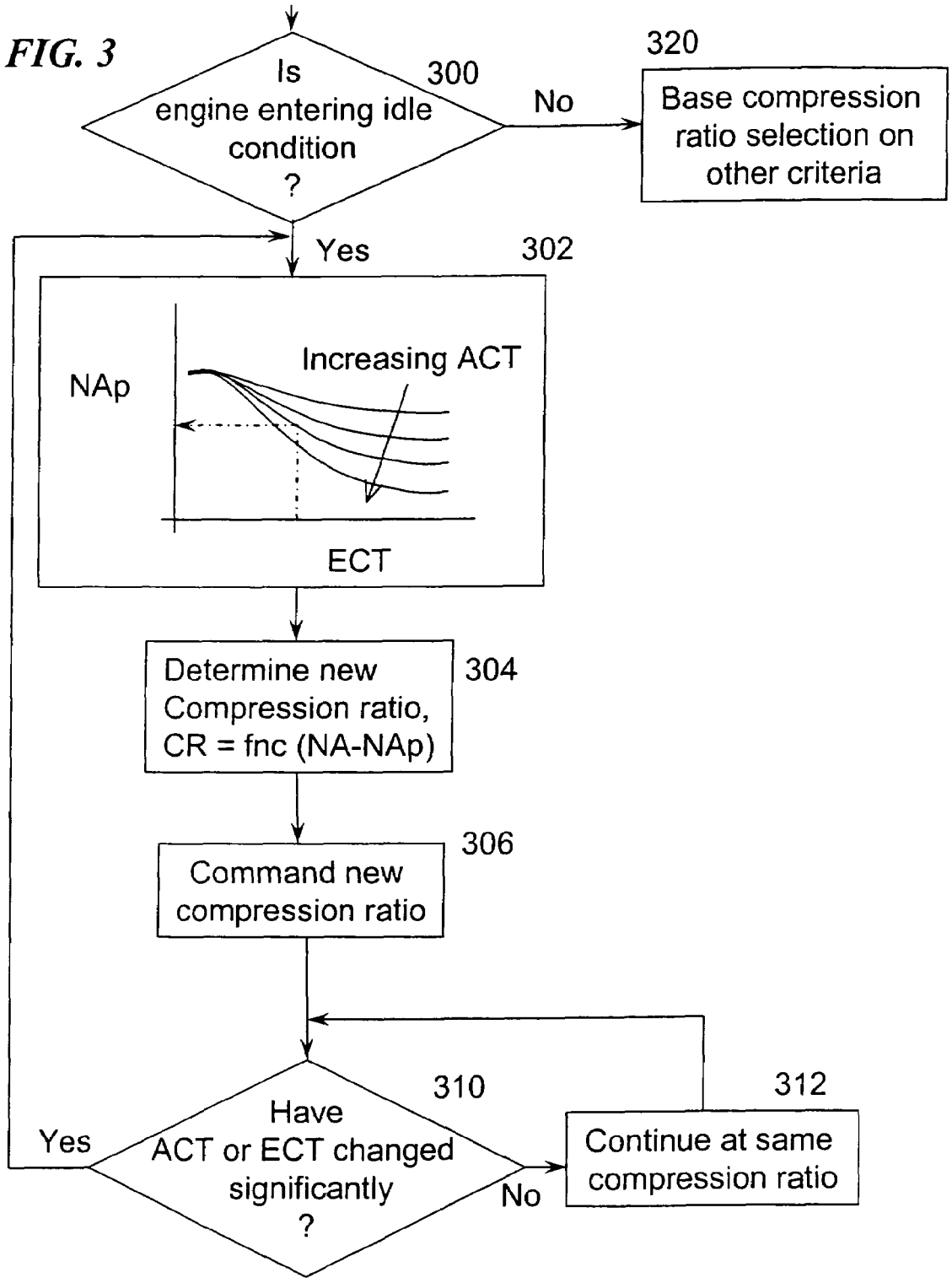
FIG. 3 is a flow diagram of a process used by the engine of FIG. 1 for selecting compression ratio and idle speed of the engine of FIG. 1 according to the invention Like reference symbols in the various drawings indicate like elements.

FIG. 2 relates to a compression ratio varying apparatus which is two step: high compression ratio and low compression ratio. FIG. 3 applies to a multi-step or continuously varying compression ratio apparatus. The description of blocks 300, 320, 302, 310, and 312 correspond to blocks 200, 220, 202, 210, and 212 of FIG. 2 and are not repeated here. Referring to block 304, a new compression ratio is determined based on NA and NAp. In one embodiment, CR=CRo−constant*(NA−NAp), where CRo is a compression ratio in the middle of the range. As NA, which is related to demanded torque, increases, the resulting CR decreases. Thus, as that propensity to knock goes up, the CR decreases. Alternatively, a lookup table or a more complicated function can be used.

When a new compression ratio is selected, an appropriate idle speed is determined. To achieve high fuel efficiency, it is desirable to idle at the lowest speed possible while maintaining acceptable combustion stability to ensure smooth idle. It is common practice to compute the power produced in the cylinder for each combustion event and to place a limit on the standard deviation on these event-to-event differences. The idle speed is calculated as:

$$RPM_{des}=RPM_{base}+\text{function}\ (T_{catalyst},\ \text{ECT, ACT, ECT}_{o},\ \text{Transmission state, AC compressor, Power steering, Misc. accessories})$$

where:

$RPM_{des}$ is the desired RPM;

$RPM_{base}$ is the base RPM, i.e., before other factors are considered;

$T_{catalyst}$ is the temperature of the catalyst (the catalyst temperature must be maintained at or above its lightoff temperature);

ECT is engine coolant temperature, which indicates engine block and oil temperature;

ACT is air charge temperature;

$ECT_{O}$, is engine coolant temperature at startup;

Transmission state, meaning neutral idle or drive idle state;

AC compressor, draw by AC compressor on engine;

Power steering, draw by power steering pump on engine; and

Misc. accessories, draw by any other accessories driven by engine.

The engine may be operated at a lower idle RPM at a higher compression ratio because the combustion is more stable at a higher CR. To account for that in the computation of $RPM_{des}$, $RPM_{base}$ is further a function of compression ratio; $RPM_{base}$=function (CR).

Furthermore, $RPM_{des}$ is clipped in the event that these adders combined exceed a maximum desired idle speed limit.

In blocks 206 and 208 of FIG. 2 and block 306 of FIG. 3, a compression ratio is commanded to the variable compression ratio device. Preferably, this is done in conjunction with controlling the idle speed according to the equation above for $RPM_{des}$ so that combustion stability is maintained throughout the transition from a non-idle condition to idle and from one compression ratio to another. Thus, within blocks 206, 208, and 306, according to one embodiment, it is implicit that RPM is controlled at the same time as a transition in compression ratio or, alternatively, just prior to such transition.

A number of embodiments of the invention have been described. Nevertheless, it will be understood that various modifications may be made without departing from the spirit and scope of the invention. Accordingly, other embodiments are within the scope of the following claims.

What is claimed is:

1. A method for selecting compression ratio in which to operate a variable compression ratio internal combustion engine, comprising:

basing the compression ratio selection on demanded engine torque and a temperature;

commanding said selected compression ratio to a compression ratio varying device coupled to the engine;

determining a desired idle speed based on said selected compression ratio; and commanding said desired idle speed to an engine controller coupled to the engine.

2. The method of claim 1 wherein said desired idle speed is based on at least one of temperature of a catalyst coupled to an engine exhaust, engine coolant temperature, engine coolant temperature at engine startup, air charge temperature, accessory loads on engine, said selected compression ratio, and status of a transmission coupled to the engine.

3. A method for selecting compression ratio in a variable compression ratio device coupled to an internal combustion engine, comprising:

determining a normalized airflow parameter based on temperature;

determining an actual normalized airflow;

selecting said compression ratio based on said normalized airflow parameter and said actual normalized airflow computing a desired idle speed based on said compression ratio selected.

4. The method of claim 3 wherein said desired idle speed is further based on said selected compression ratio and at least one of a temperature of the catalyst, engine coolant temperature, air charge temperature, engine coolant temperature at engine startup, state of the transmission, air conditioner compressor load, and power steering load.

5. The method of claim 4 wherein said state of the transmission comprises drive idle and neutral idle.

6. The method of claim 3, further comprising: commanding said desired idle speed and said selected compression ratio to ensure smooth engine operation during transitions.

7. An article of manufacture comprising:

a computer storage medium having a computer program encoded therein for selecting compression ratio of a variable compression ratio internal combustion engine when such engine is operating under an idle speed condition, said computer storage medium comprising:

code for determining a normalized airflow parameter (NAp) based on a plurality of engine operating parameters;

code for determining actual normalized airflow (NA);

code for selecting a high compression ratio when NA<NAp and for selecting a low compression ratio when NA>NAp.

8. The article of claim 7, said computer storage medium further comprising: code for determining a desired idle speed based on a plurality of engine operating parameters.

9. The article of claim 7, said computer storage medium further comprising: code for commanding said desired idle speed and said selected compression ratio to said engine.

10. A method for selecting compression ratio in which to operate a variable compression ratio internal combustion engine, comprising:

basing the compression ratio selection on demanded engine torque;

commanding said selected compression ratio to a compression ratio varying device coupled to the engine;

determining a desired idle speed based on said selected compression ratio; and commanding said desired idle speed to an engine controller coupled to the engine.

11. The method of claim 10 wherein said desired idle speed is based on at least one of temperature of a catalyst coupled to an engine exhaust, engine coolant temperature, engine coolant temperature at engine startup, air charge temperature, accessory loads on engine, said selected compression ratio, and status of a transmission coupled to the engine.

12. A method for selecting compression ratio in a variable compression ratio device coupled to an internal combustion engine, comprising:

determining a normalized airflow parameter;

determining an actual normalized airflow;

selecting said compression ratio based on said normalized airflow parameter and said actual normalized airflow;

computing a desired idle speed based on said compression ratio selected.

13. The method of claim 12 wherein said desired idle speed is further based on said selected compression ratio and at least one of a temperature of the catalyst, engine coolant temperature, air charge temperature, engine coolant temperature at engine startup, state of the transmission, air conditioner compressor load, and power steering load.

14. The method of claim 13 wherein said state of the transmission comprises drive idle and neutral idle.

15. The method of claim 12, further comprising: commanding said desired idle speed and said selected compression ratio to ensure smooth engine operation during transitions.

* * * * *